US010993499B2

(12) United States Patent
Stirling

(10) Patent No.: US 10,993,499 B2
(45) Date of Patent: May 4, 2021

(54) PROTECTIVE SOFT-SHELLED FOOT COVERING

(71) Applicant: Jennifer Stirling, Gilbert, AZ (US)

(72) Inventor: Jennifer Stirling, Gilbert, AZ (US)

(73) Assignee: Jennifer Stirling, Gilbert, AZ (US)

( * ) Notice: Subject to any disclaimer, the term of this patent is extended or adjusted under 35 U.S.C. 154(b) by 148 days.

(21) Appl. No.: 16/179,902

(22) Filed: Nov. 3, 2018

(65) Prior Publication Data

US 2020/0138143 A1 May 7, 2020

(51) Int. Cl.

| | |
|---|---|
| ***A43B 3/12*** | (2006.01) |
| ***A43D 8/26*** | (2006.01) |
| ***A43B 13/32*** | (2006.01) |
| ***A43B 3/00*** | (2006.01) |
| ***A43B 9/12*** | (2006.01) |
| ***A43C 11/00*** | (2006.01) |

(52) U.S. Cl.

CPC ..... *A43B 3/124* (2013.01); *A43B 3/0036* (2013.01); *A43B 9/12* (2013.01); *A43B 13/32* (2013.01); *A43C 11/00* (2013.01); *A43D 8/26* (2013.01)

(58) Field of Classification Search

CPC ..... A43B 3/0036; A43B 5/12; A43B 9/12; A43B 17/00; A43B 23/04; A43B 23/042; A61F 13/064; A61F 13/065; A61F 13/066; A61F 13/067; A61F 13/068

See application file for complete search history.

(56) References Cited

U.S. PATENT DOCUMENTS

| | | | | | |
|---|---|---|---|---|---|
| 1,788,852 | A * | 1/1931 | Arthur | A61F 13/064 | 602/66 |
| 2,358,966 | A * | 9/1944 | Einstoss | A61F 13/065 | 602/66 |
| 3,002,297 | A * | 10/1961 | Neilson | A43B 3/124 | 36/11.5 |
| 3,508,544 | A * | 4/1970 | Moore | A61F 13/069 | 128/892 |
| 3,762,075 | A * | 10/1973 | Munschy | A43B 3/163 | 36/97 |
| 4,136,468 | A * | 1/1979 | Munschy | A43B 3/26 | 36/97 |
| 4,150,498 | A * | 4/1979 | Palmer | A43B 3/106 | 2/239 |
| 4,845,862 | A * | 7/1989 | Phillips, Jr. | A43B 1/14 | 36/83 |
| 6,427,363 | B1 * | 8/2002 | Hunter | A43B 3/24 | 36/100 |
| 6,684,442 | B1 * | 2/2004 | Parker | A43B 3/106 | 12/142 R |
| 7,845,094 | B1 * | 12/2010 | Gaskins, Jr. | A43C 15/00 | 36/7.6 |

(Continued)

*Primary Examiner* — Alissa L Hoey
*Assistant Examiner* — Patrick J. Lynch
(74) *Attorney, Agent, or Firm* — Chris A. Watt

(57) ABSTRACT

A method providing for making and using a soft-shelled foot covering, by placing a foot within a covering such as a sock, placing the foot with the foot covering within an outline pattern, and manipulating various straps of the outline pattern, such as an inside heel strap, an outside heel strap, an inside ball-of-the-foot strap, an outside ball-of-the-foot strap, a center toes strap, an inside big toe strap, and an outside little toe strap around the foot and other straps, thereby keeping the straps in place and securing the pattern to the foot.

11 Claims, 10 Drawing Sheets

(56) References Cited

U.S. PATENT DOCUMENTS

| | | | | |
|---|---|---|---|---|
| 10,299,953 | B2 * | 5/2019 | Bushby | A61F 13/067 |
| 2013/0261525 | A1 * | 10/2013 | Lieberson | A61F 5/019<br>602/30 |
| 2013/0318822 | A1 * | 12/2013 | Wang | A43B 23/042<br>36/83 |
| 2014/0052040 | A1 * | 2/2014 | Coates | A61F 13/067<br>602/28 |
| 2014/0068837 | A1 * | 3/2014 | Roon | A43B 3/106<br>2/239 |
| 2015/0025432 | A1 * | 1/2015 | Liden | A61F 5/0585<br>602/12 |
| 2015/0282565 | A1 * | 10/2015 | Kilgore | A43B 23/227<br>36/45 |
| 2016/0338449 | A1 * | 11/2016 | Steuerwald | A43B 5/14 |
| 2016/0377139 | A1 * | 12/2016 | Vito | A63B 71/0054<br>267/141 |
| 2017/0188661 | A1 * | 7/2017 | Lee | A43B 23/0245 |
| 2019/0125004 | A1 * | 5/2019 | Thomas | A43B 3/16 |
| 2020/0068995 | A1 * | 3/2020 | Juckelandt | A43B 1/10 |

* cited by examiner

PROTECTIVE SOFT-SHELLED FOOT COVERING

FIELD OF THE INVENTION

The present inventions generally relate to the field of footwear and specifically to the field of footwear providing greater flexibility and comfort than traditional running footwear, thereby protecting the user's feet from the environment while also allowing the user to achieve the sensation of barefoot running.

SUMMARY OF THE INVENTION

The present inventions provide means for making and using an article of manufacture, and the associated method steps for making and using a soft-shelled foot covering.

The above features and advantages of the present invention will be better understood from the following detailed description taken in conjunction with the accompanying drawings.

DETAILED DESCRIPTION

Figure 1:
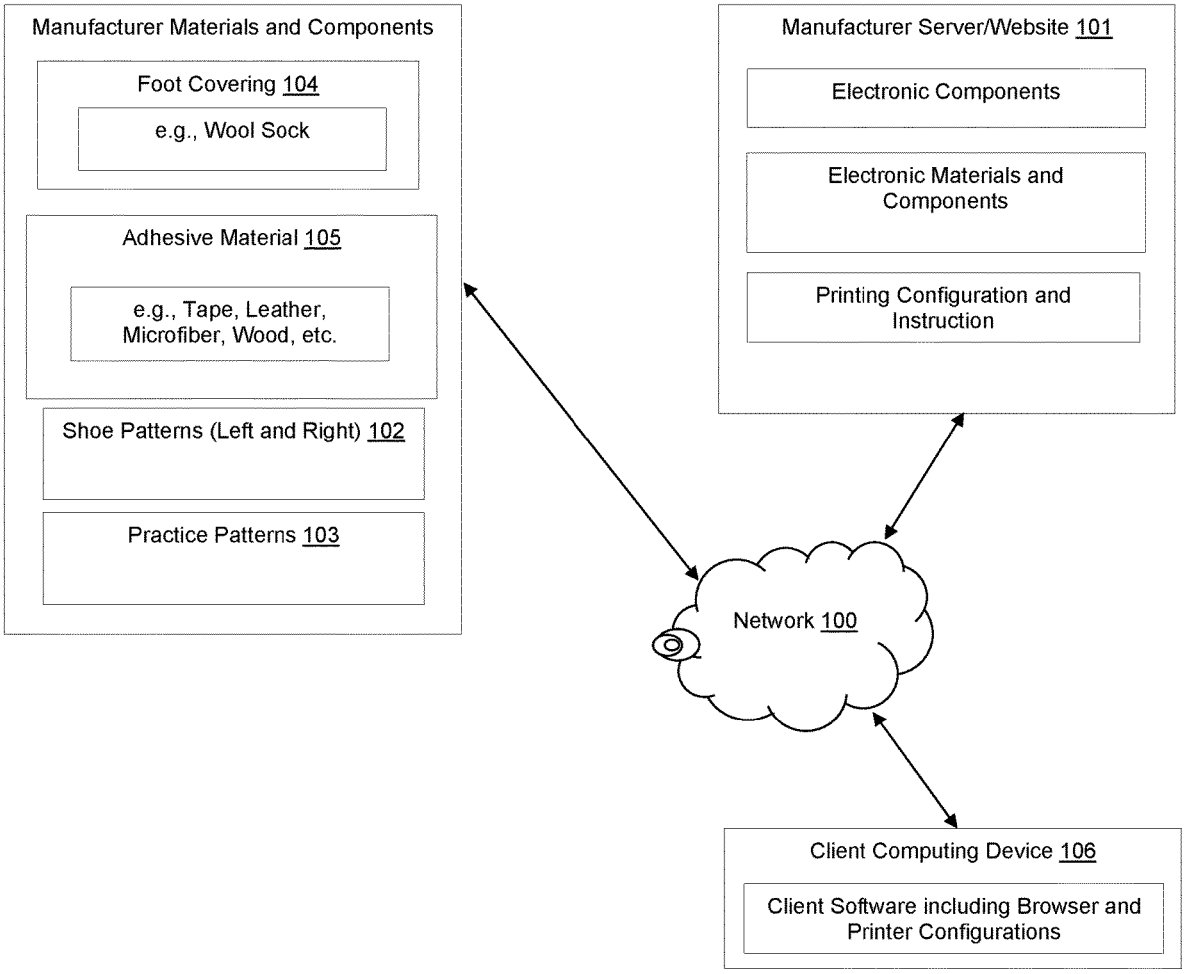
FIG. 1 illustrates an article of manufacture and method steps associated with the manufacture and use of a protective soft-shelled foot covering.

The present inventions will now be discussed in detail with regard to the attached drawing figures that were briefly described above. In the following description, numerous specific details are set forth illustrating the Applicant's best mode for practicing the invention and enabling one of ordinary skill in the art to make and use the invention. It will be obvious, however, to one skilled in the art that the present invention may be practiced without many of these specific details. In other instances, well-known machines, structures, and method steps have not been described in particular detail in order to avoid unnecessarily obscuring the present invention. Unless otherwise indicated, like parts and method steps are referred to with like reference numerals.

Historically, runners participating in long-distance training may experience trouble by way of running injuries, and/irritation to the feet (e.g., the heels) caused by the running shoes, such as those experienced due to "pump bumps," resulting from calcium deposits or corns on the heels, or rubbing to the back heel of the foot, resulting in tendonitis pain. Other sandals, shoes and/or zero-drop shoes on the market have historically manifested similar issues to those encountered with regular running shoes, such as the heel injuries or irritation as described above.

One option available to the runner, in order to avoid the problems described above, is to participate in barefoot training. However, environmental factors may make barefoot training impractical. For example, for runners living in the desert southwest, heat conditions may prevent barefoot training. Similarly, rocks, sticks, plants, and thorns may cause abrasions on the runner's feet and lower legs.

Applicant has observed that alternatives to running with shoes and/or barefoot training either: are too restrictive, causing the runner to be claustrophobic (e.g., in the toe area); cause the same problems to the feet, heels, and lower legs as described above; and/or create a "sticky" sensation where a foot covering may be directly applied to the foot and/or lower leg.

Such alternative options for running and/or training barefoot also may lack durability, and as the foot covering begins to wear, may give the runner the sensation that the product will soon come off, creating insecurity in the use of the foot covering.

Applicant has therefore determined that current foot coverings do not accomplish optimum comfort, durability, style, and/or affordability, thereby failing to provide a barefoot-running alternative that feels like running barefoot while still offering protection from the running environment.

Applicant has further found that more optimal articles of manufacture, methods, and systems are needed which achieve an optimum running or barefoot-training alternative that provides the sensation of running barefoot while simultaneously offering protection from the environment, thereby providing optimum comfort, durability, style, and/or affordability.

Different embodiments of such alternatives, as described in the embodiments herein, may include a non-restrictive padded foot covering, worn directly on the foot, thereby providing comfort and freedom of movement to the user. These embodiments may also include a protective covering for the padded foot covering, which may be applied to the bottom and outer edges of the padded foot covering to provide durability for the padded foot covering and the foot itself, further providing a comfortable and non-restrictive alternative, as well as providing the foot and padded foot covering with some measure of protection from heat, cold, rocks, plants, sticks, thorns, abrasion, etc.

As a non-limiting example, an alternative to running or barefoot training may include running in socks. However, Applicant has found that most socks wear through after less than a mile. To remedy this problem, some embodiments described herein include a model and design including a durable covering including adhesive substance, such as a sticker, tape, and/or other adhesive material, applied directly to a sock, thereby providing a practical, durable, comfortable, and affordable protective foot covering as an alternative to running barefoot or in socks. In this non-limiting example embodiment, the durable adhesive covering is attached to the sock or other foot covering, thereby offering the user a non-restrictive measure of protection against environmental elements presented by outdoor or other environmental conditions (e.g., heat, cold, rocks, sticks, thorns, etc.).

Applicant has found that this model may be used in extremes of weather, including extreme heat, or snowy or other cold conditions, while keeping the runner's foot cool or warm, respectively. This model may also provide the runner with traction and protection, as described above. Finally, Applicant has found that this model is the only barefoot covering that is intended to be worn on the outside of a protective covering, such as a sock, and not directly applied to the foot.

Figure 2:
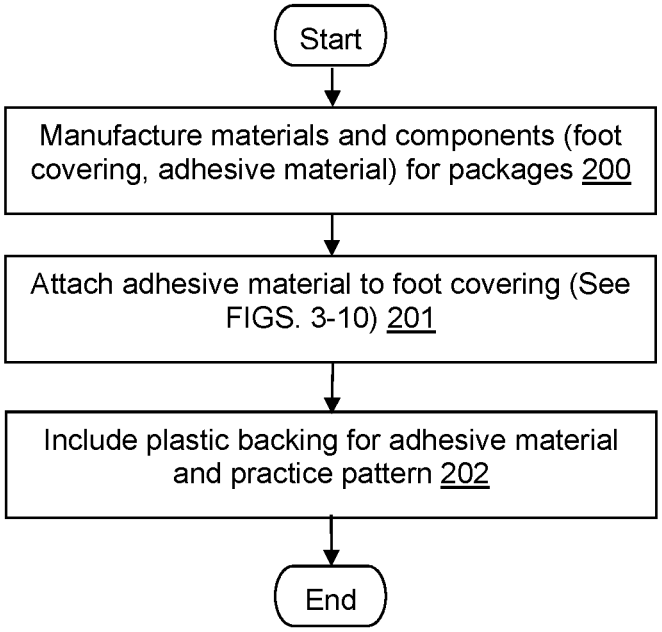
FIG. 2 illustrates an article of manufacture and method steps associated with the manufacture and use of a protective soft-shelled foot covering.

Turning now to FIGS. 1-2, a manufacturer may provide all of the materials and components necessary for users, such as runners or other athletes, to assemble and use the embodiments described in detail below. In some embodiments, the manufacturer may provide a website or other technology 101, allowing users of the technology to access means to download the electronic components necessary to assemble and use the embodiments described below.

These embodiments may include any server-client architecture as is known in the art. As a non-limiting example, this architecture may include one or more server computing devices 101, which may include one or more processors executing software or other electronic instructions within a memory, and/or one or more client computing devices 106, which also may include one or more processors executing software or other electronic instructions within a memory, possibly in conjunction with server(s) 101, both of which may be communicatively coupled to a network 100, such as the Internet as a non-limiting example, as seen in FIGS. 1-2. The server(s) 101 and client(s) 106 may be customized or otherwise specifically designed to execute the method steps described herein.

The server 101 may be any server computing device and/or software configured to serve data over any network 100. The client computing device 106 may be any user device including software, such as a client desktop or laptop computer, network terminal, smart phone, tablet, etc. that provides software and/or one or more user interfaces, possibly using an internet browser, to receive input from the user and provide visual feedback displaying the results of calculations run by the software running on the server 101 and/or the client 106. In these embodiments, an electronic version of any of the materials and components, described in detail below, may be accessible to the user using the client computing device 106.

As a non-limiting example, server 101 may host the manufacturer website, and the client 106 may access the information from the server 101 using, as non-limiting examples, a downloaded software or "app," or may access the manufacturer's website using a web browser, etc. The user may access the manufacturer's website 101, which may be coupled through network 100 to a database of patterns, styles, sizes, etc. (as described below). Using the client's software or other instructions, the user may select, possibly using a graphical user interface (GUI) displayed on the client 106, a desired pattern, style, size, etc. as described below.

Once the information in the user has downloaded the desired information from the database for use on the client machine 106 (possibly in conjunction with software running on server 101), the client machine 106 may be configured to connect, possibly through the network to print the foot covering 104, adhesive material 105, shoe patterns 102, and/or practice patterns 103. In some embodiments, as non-limiting examples, printing the foot covering 104 may include printing the guidelines on the foot covering (e.g., printing guidelines on a sock), and printing the adhesive material 105, shoe patterns 102, and/or practice patterns 103 may include feeding a selected paper, material, pattern, etc., as described below, into the printer, which may then be printed using the information from the database selected by the user.

In embodiments in which the manufacturer provides all materials and components necessary for users (Step 200), the manufacturer may include any combination of: one or more sandal or shoe patterns 102, in any men's or women's size, as described in detail below in association with FIGS. 1-10; one or more practice patterns 103 for practicing affixing the material to the sock or other foot covering; paper for practicing attaching the material to the foot covering 104; the adhesive material 105 to attach to the foot covering; and in some embodiments, the foot covering itself 104 (e.g., a complimentary pair of socks, pre-marked to guide the user in affixing the included adhesive material). In some embodiments, the package may include a pamphlet of instructions for use, as well as means to access the website or other technology described below.

In some embodiments, the contents of the package may be placed over corrugated fiberboard and covered/enclosed tightly in a thin/durable plastic wrap so that the contents of the package may be seen in their entirety by a customer. The cover for the contents may be labeled to include the product name (e.g., "Hot One" for the shoe pattern, or "Chill One" for the sandal pattern), as well as the intended user (e.g., men, women, teens, children), and the applicable size. In some embodiments, the plastic wrap may include a strip or seal that allows the customer to open the product packaging and access the product easily without damaging the product.

As noted above, a manufacturer may produce and include, within the package, one or more patterns 102 for a shoe or sandal version of the embodiments described herein. These patterns 102 may be printed as square or rectangular "cut-outs," which allow the user to generate paper practice patterns 103, or the final product, using the material and adhesive 105 used to attach the material to the foot covering 104.

In the disclosed embodiments, the foot covering 104 includes a pair of socks. However, this example is non-limiting. Any foot covering 104 capable of attaching an adhesive material 105 may be used. For example, a wrap of any kind around the foot/sock, or any sticker-pad applied to the outside of the sock for the purpose of barefoot running may be used. This foot covering may further be of any style, color, or design. In some embodiments, the foot covering may be manufactured and included with the package described above. In some embodiments, the foot covering 104 may be made available for purchase separately. The manufacturer may use any machine or means known in the art for printing guidelines or a map directly on the foot covering 104, These guidelines or map may guide the wearer in applying the adhesive material perfectly the first time, allowing "stress free" application for the user.

While any foot covering may be used, the manufacturer may consider various thicknesses or materials. For example, thick wool socks may provide an optimal running experience in cold weather, while simultaneously providing a stable surface for the tape. As non-limiting examples of the types of socks that may be used for the foot covering 104, any type of adhesive material 105 should work with any style of sock (low cut, knee length, calf length, mid-calf length, crew length, quarter length, etc.).

In some embodiments, the manufacturer may consider, in designing and manufacturing the foot covering 104 and adhesive material 105, that the adhesive material 105 may be intended to stick and remain on the foot covering 104 until completely worn through. The adhesive material 105 may not come off easily after being applied, and may lose its "stick" if removal and re-application is attempted, so it is important for the adhesive material 105 to be applied correctly the first time.

Each packaging unit is designed to include both a practice cutout for each foot, as well as the adhesive material cutout for the final product. Thus, each package will include a total of four cutouts per unit: two for the right foot and two for the left.

Each of these cutouts may be printed on a square or rectangular material, such as paper or cardboard, or the material itself. The square/rectangular material may further be applied to an identical-sized square/rectangular pre-cut plastic backing. These specific cuts in the plastic backing will ensure adhesive material 105 removal from the plastic is seamless and allow ease of application of the adhesive material to the foot covering 104.

The practice cutout, included with the adhesive material cutout, may be identical to the pattern for the adhesive material cutout. This "paper pattern replica" of the adhesive material cutout may be cut out and "tried on" either foot by the user so that the user can practice application prior to applying the actual sticker product, which cannot be removed and re-applied easily, as noted above. Thus, in some embodiments, the practice cutout may include an identical square/rectangular double-sided paper printout (mirrored) that is dimensionally and visually identical to the right-foot adhesive material cutouts (one side of the paper) and left-foot material cutouts (other side of the paper).

The manufacturer would be wise to choose the most economical sizing and placement of design for the desired foot-size cutout. For example, the manufacturer may create the enclosed embodiments following a design proportionally smaller or larger to accommodate any foot size. As a non-limiting example, the embodiments described herein are sized to a size 7½ woman's foot. However, these example embodiments are non-limiting. The disclosed embodiments may be manufactured for any shoe size or intended user.

The manufacturer may use any material for the adhesive material 105. As non-limiting examples, the disclosed embodiments may be manufactured using duct tape, any other tape (e.g., surgical/medical tape, gaffer tape, gorilla tape, duct tape extreme, speed tape, stick tape, etc.), cloth, leather, wood, moleskin, deerskin, synthetic leather, rope, hemp, cloth, paper, rubber, foam, microfiber, plastic, plastic wrap, tin foil, metal, etc., or any combination thereof. In keeping with the goal to protect the user from the environment, the selected material may: keep the user cool or warm (e.g., wool socks); provide better traction; repel moisture; protect the user from abrasion from rocky/thorny surfaces (e.g., rubber soles); etc.

The cutout patterns may include an outline of a foot, which is the surface area on which the bottom of the foot will be placed.

Because certain areas of the foot (e.g., where the foot makes contact with the ground first) experience more wear than other areas, these areas may require additional layers of adhesive material 105 to reinforce those areas. Thus, in some embodiments, the adhesive material 105 within the outline of the foot may be composed of three layers of material: a base layer, middle layer, and top layer, thereby providing extra layers and ensuring durability and strength to the area of the shoe/sandal that will receive the most abrasion during a run.

In some embodiments, the top layer material may be seamless: blended in, melted in, flush with, or otherwise combined with the single layer of material that makes up the remainder of the adhesive material 105, thereby providing aid in comfort for the wearer and resilience to movement/flexibility.

In embodiments where the layers cannot be combined with each other or the additional adhesive material 105 (e.g., in embodiments where the material is cloth or leather), additional layers may be applied (e.g., sewn) to the under layers of the adhesive material 105, rather than the top, which minimizes possible abrasion to the wearer.

In some embodiments, additional layers of adhesive material may be included. As a non-limiting example, additional layers of material may be manufactured and included with the product and/or sold separately (4 pairs of sole stickers recommended). As a non-limiting example, the user may opt to add sole stickers to the base of the foot as the original sticker wears down.

In some embodiments, the manufacturer may maintain a website 101, including patterns for the practice cutouts and adhesive material cutouts. In addition, the website may include specific prints, colors, or artwork to be applied to the adhesive material. In these embodiments, the user may download the appropriate patterns, including the desired print/color/artwork, from the manufacturer's website, in order to customize their experience. Thus, the material used in the disclosed embodiments may include any printed, drawn, decorative, or painted designs, applications, glitters, and colors.

In some embodiments, the manufacturer's website 101 and/or the user's printer may be configured to print numbers to the plastic backing as included in the designs, as described above, which will assist the user in following the written directions, allowing ease of application of the adhesive material 105 to the foot covering 104.

The pamphlet or other materials included with the manufacturer's package and/or website 101, may include directions for wear and application, company contact information, company website 101 and video links, warnings, and disclaimers as well as suggested exercises and stretches for before and after a run, possibly catered to barefoot runners.

In embodiments including a package of all materials and components generated by a manufacturer, the user may use the disclosed embodiments by removing the plastic seal or strip from the packaging and accessing two of the four total patterns (e.g., two for the right foot and two for the left), including the pattern for the paper "practice pattern" and the pattern for the final product's adhesive material, as well as the pamphlet including manufacturer instructions. It is recommended that users read the instructions in their entirety.

In some embodiments, the user may register the product online, which may require address, phone number, height, weight, and approximate miles run per week. As an aside, this information may be used to help the manufacturer better understand the product and move development forward. During registration, the customer may be prompted to make an account, sign a disclaimer that covers misuse, and encouraged to return to the web site to give feedback on the product once it has worn out. In some embodiments, the customer may be awarded a free replacement product, and/or be encouraged to sign up for automatic periodic shipment of replacement products.

The user may then access the "paper pattern replica" sheet, and, using scissors, cut along the outside edges of the paper "foot" for the paper shoe/sandal. Using the numbers and dotted lines as guides, as described in detail below, the user may practice applying the paper (indicated when "R" for the right foot in the center of the main body of the shoe/sandal, correct-side and face up in front of the user, or an "L" for the left foot) to the correct foot Once the user is comfortable with the application of the paper shoe/sandal, the user can feel comfortable and confident about applying the adhesive material 105, in the shoe or sandal style, to the foot covering 104.

The user may then put on desired foot covering 104, such as socks. The user should note that the adhesive material will not come off of the foot covering easily, if ever (e.g., duct tape is difficult to remove from a sock), so the user should choose a foot covering 104 that may be permanently attached to the adhesive material 105. If guide lines are included (i.e., printed) on the foot covering 104, these may provide an optimal means for first time users to apply the adhesive material 105 to the foot covering 104.

The user may then place the adhesive material product face-down so that the plastic is facing up. The user may recognize the correct face up/face down selection by the indicative numbers, dotted lines, an "R" or an "L" in the center of the main body right side up in front of the user.

Applicant notes that the straps and/or tabs used in the following description will be referred to according to the beginning position of the strap: whether the strap/tab is inside or outside of the foot (e.g., the left side of the right foot and the right side of the right foot, respectively), and the part of the foot to which the beginning position is closest (e.g., the ball of the foot)

Figure 3:
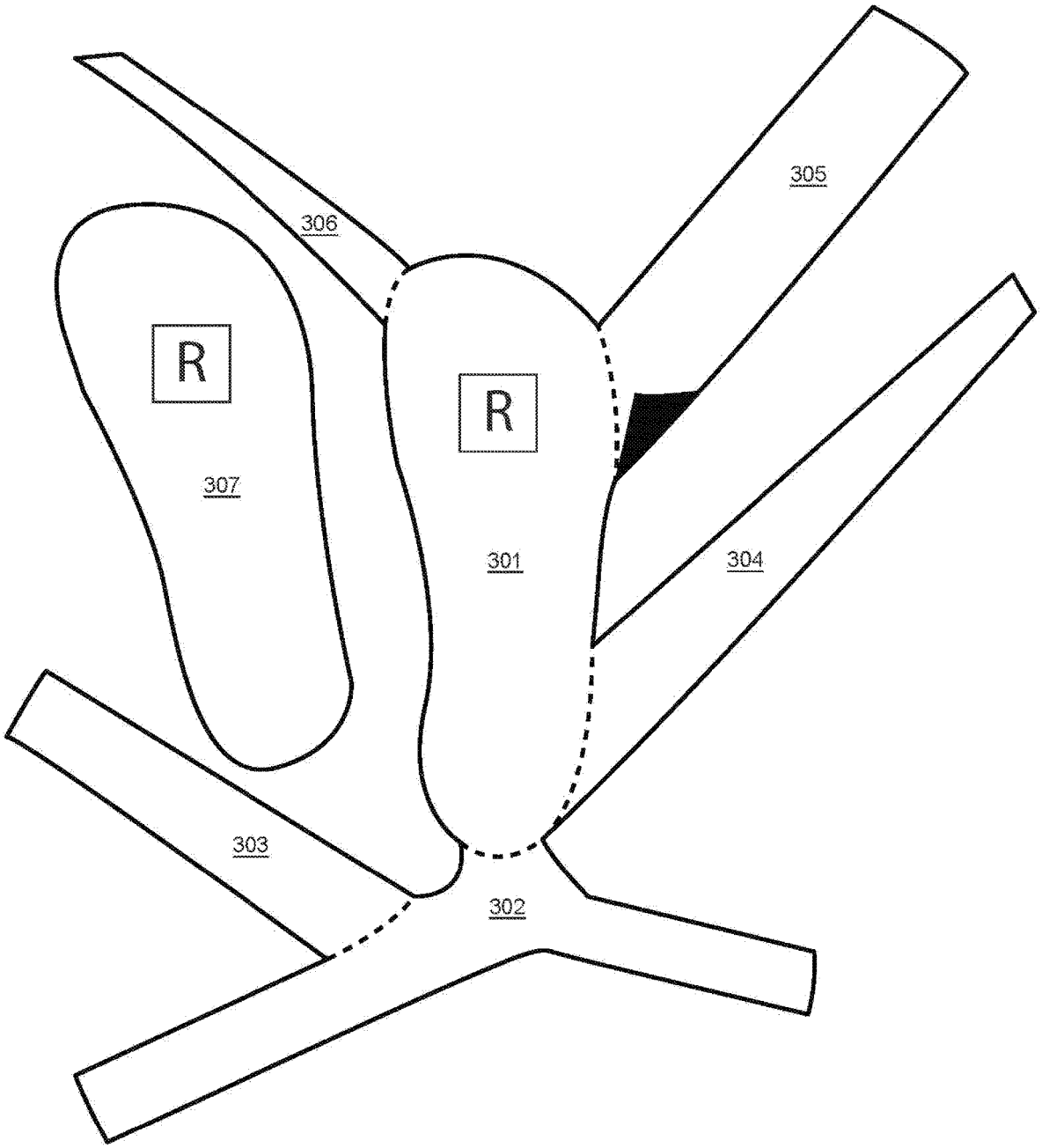
FIG. 3 illustrates an article of manufacture and method steps associated with the manufacture and use of a protective soft-shelled foot covering.
Figure 4:
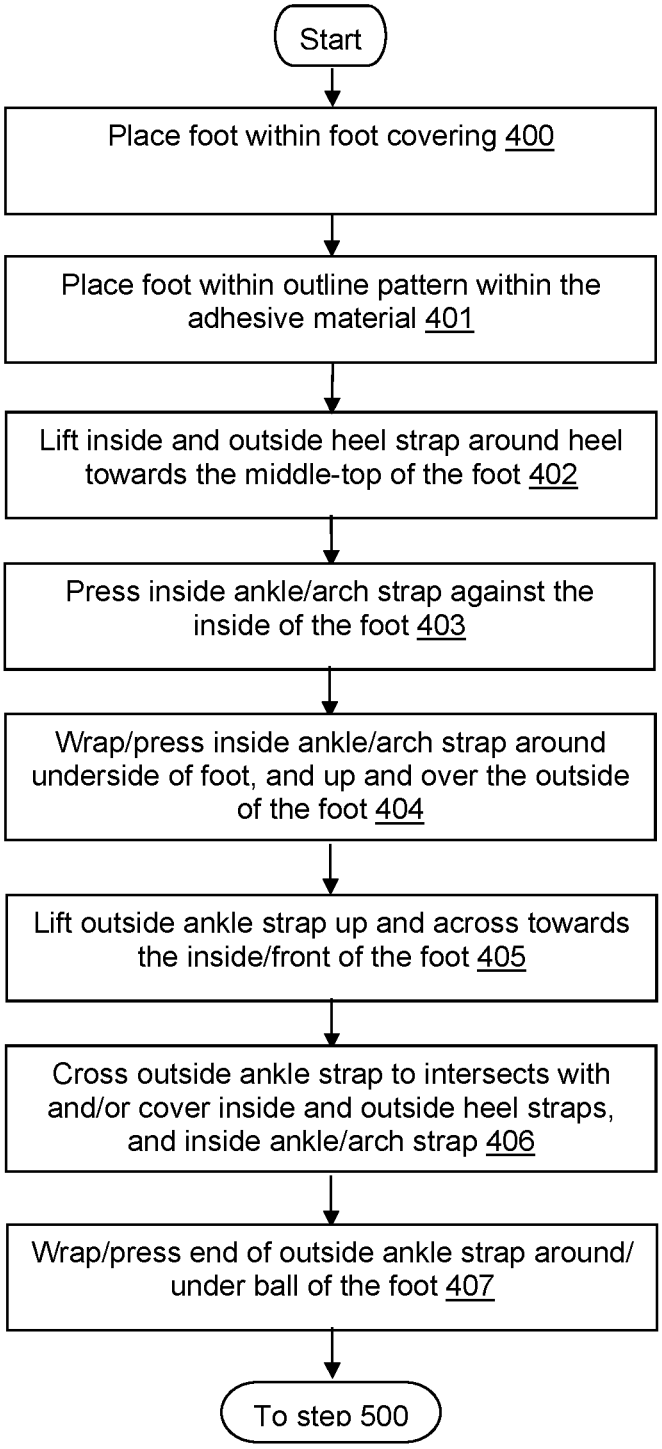
FIG. 4 illustrates an article of manufacture and method steps associated with the manufacture and use of a protective soft-shelled foot covering.
Figure 5:
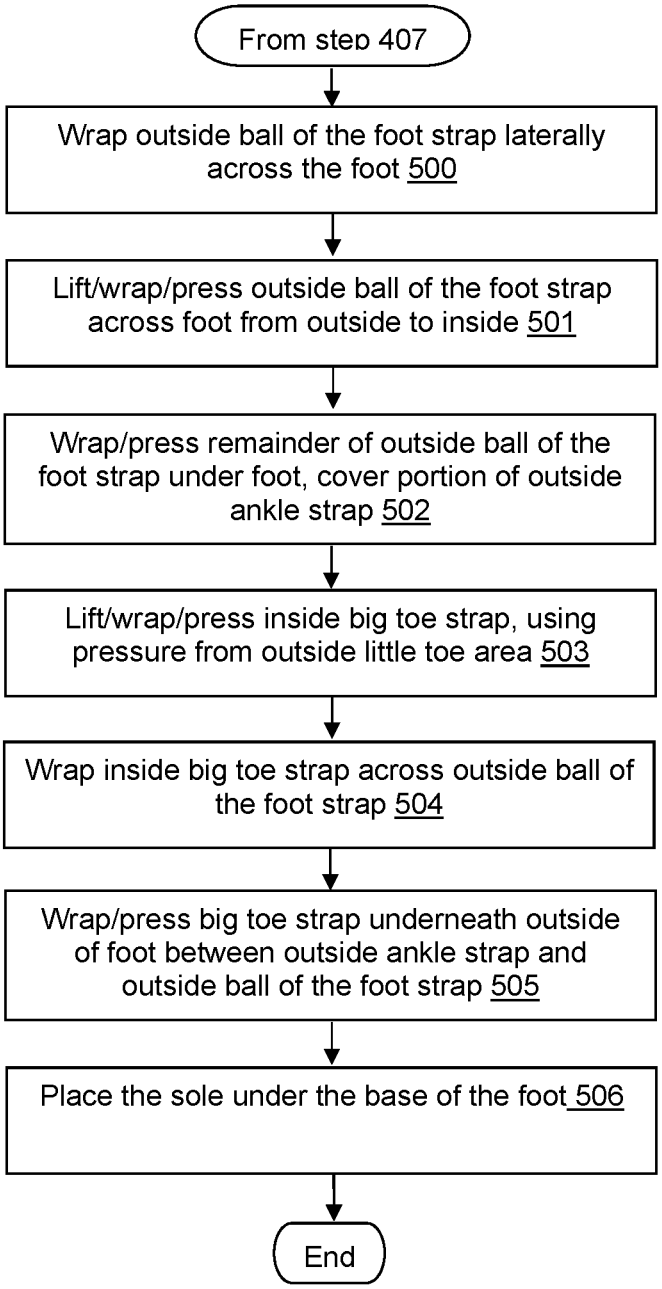
FIG. 5 illustrates an article of manufacture and method steps associated with the manufacture and use of a protective soft-shelled foot covering.

Turning now to FIGS. 3-5, which represent a sandal style/version of the disclosed invention, the user may review the outline/pattern 301 for the foot to determine the appropriate foot (left or right) to place within the outline/pattern 301. As demonstrated in Step 401 of FIG. 4, the user may then place the appropriate foot within this area of the outline/pattern, with the heel of the foot flush against dotted line "heel" area of the cutout. By doing so, the user may also confirm that the sizing selected for the pattern is appropriate for their foot.

In embodiments that include a sticker or other adhesive material attached to a sock or other foot covering, the user may need to hold one of the top outside corners of the sticker-mat with one hand and kneel on the outside corners of the sticker-mat with their knees. The user may then peel the plastic from the heel of the outline/pattern 301 up towards the toes area, being careful not to allow any of the exposed sticker area to fold in on itself or touch any object. The user may then discard the removed plastic and carefully place the appropriate right or left foot in this area with the heel of the foot flush against the heel area of the outline/pattern 301.

The process steps described above, either individually or in combination, may be repeated for both the paper practice pattern and the final application of the adhesive material to the foot covering (e.g., applying a pre-made sticker to a sock).

Prior to applying the adhesive material in the subsequent steps, the user may want to lay a thin piece of tissue paper or other material around the toes area of the foot. This may prevent the adhesive material from constricting the toes or from being too tight in the toe area.

Turning now to Step 402 of FIG. 4, the user may lift up the inside and outside heel straps 302 of the cutout, and wrap and press the inside and outside heel straps 302, respectively around the back of the heel and towards the middle-top of the foot. The user may choose to place the inside and outside heel straps 302 so that they lie below the protruding portion of the respective lower ankle bones. Placing the inside and outside heel straps 302 too close, on, or above this area could result in uncomfortable rubbing and inflexibility. The end of the inside and outside heel straps 302 may touch or intersect on top of the foot depending on the size of the user's foot.

In embodiments that include a sticker or other adhesive material attached to a sock or other foot covering, the user may lift the sticker or adhesive material on the inside and outside heel straps 302 from the mat, without removing the plastic. The user may then peel back the plastic from the inside heel strap, without removing the plastic from the outside heel strap, peeling back the plastic from the inside area closest to the foot, towards the outside edges of the sticker-mat, being careful not to allow any of the exposed sticker area to fold in on itself or touch any object. The user may choose to discard the removed plastic. The user may then carefully wrap and press the inside and outside heel straps 302 of the cutout around the back of the heel and towards the middle-top of the foot, pressing the cutout into place, so that the heel area looks and feels "fitted."

The process steps described above, either individually or in combination, may be repeated for both the paper practice pattern and the final application of the adhesive material to the foot covering (e.g., applying a pre-made sticker to a sock).

Turning now to Steps 403 and 404 of FIG. 4, the user may press down the inside ankle/arch strap 3 naturally against the inside of the foot (i.e., the left side of the right foot, and right side of the left foot). The user may then wrap and press the inside ankle/arch strap 3 around the underside of the foot, and up and over the outside of the foot (i.e., the right side of the right foot, and the left side of the left foot).

In embodiments that include a sticker or other adhesive material attached to a sock or other foot covering, the user may peel back plastic for the ankle/arch strap 303 from the inside (area closest to the foot) towards the outside edges of the sticker or other adhesive material, being careful not to allow any of the exposed adhesive area to fold in on itself or touch any object. The user may then discard the removed plastic. The user may press down the inside ankle/arch strap 303 naturally against the inside of the foot, and may then wrap and press the inside ankle/arch strap 303 around the underside of the foot, and up and over the outside of the foot.

The process steps described above, either individually or in combination, may be repeated for both the paper practice pattern and the final application of the adhesive material to the foot covering (e.g., applying a pre-made sticker to a sock).

Turning now to Step 405-407 of FIG. 4, the user may lift the outside ankle strap 304 up and across towards the inside/front of the foot. The user should cross the outside ankle strap 4 so that it intersects with and/or covers the inside and outside heel straps 302, as well as the inside ankle/arch strap 303. The user may then wrap and press the end of the outside ankle strap 4 around and under the ball-area of the foot.

In embodiments that include a sticker or other adhesive material attached to a sock or other foot covering, the user may peel back plastic on the adhesive material from the inside (area closest to the foot) towards the outside edges of the sticker-mat, being careful not to allow any of the exposed adhesive area to fold in on itself or touch any object. The user may then discard the removed plastic. The user may lift the outside ankle strap 304 up, then wrap and press it across the foot towards the inside/front of the foot. In some embodiments, the user may cross the outside ankle strap 304 so that it intersects with and/or covers the inside and outside heel straps 302, as well as the inside ankle/arch strap 303. User may then wrap and press the end of the outside ankle strap 304 around and under the ball-area of the foot.

The process steps described above, either individually or in combination, may be repeated for both the paper practice pattern and the final application of the adhesive material to the foot covering (e.g., applying a pre-made sticker to a sock).

Turning now to Steps 500-502 in FIG. 5, the user may pinch and fold the striped-area of the outside ball of the foot strap 305 so that the outside ball of the foot strap 305 can wrap laterally across the foot. The user may then lift the outside ball of the foot strap 305, and wrap and press it across the foot from the outside to the inside of the foot (from right to left on the right foot, or from left to right on the left foot). The user may then wrap and press the remainder of the outside ball of the foot strap 305 underneath the foot, which should cover a portion of the outside ankle strap 304.

The process steps described above, either individually or in combination, may be repeated for both the paper practice pattern and the final application of the adhesive material to the foot covering (e.g., applying a pre-made sticker to a sock).

Turning now to Steps 503-505 of FIG. 5, the user may loosely lift the inside big toe strap 6 (not pulling too tight, as restricting the toe area could lead to discomfort), and wrap and press, using pressure from the outside little toe area. The user may wrap the inside big toe strap 306 across the outside ball of the foot strap 305, then wrap and press the big toe strap 306 underneath the outside of the foot between the outside ankle strap 304 and the outside ball of the foot strap 305.

The process steps described above, either individually or in combination, may be repeated for both the paper practice pattern and the final application of the adhesive material to the foot covering (e.g., applying a pre-made sticker to a sock).

Turning now to Step 506 in FIG. 5, the user may find the sole 307 for the correct foot (right foot indicated with an "R;" left foot indicated with an "L") and place the sole 307 under the base of the foot. This will help keep the inside ankle strap 303, the outside ankle strap 304, the outside ball of the foot strap 305, and the inside big toe strap 306 in place and provide extra reinforcement for the sandal.

In embodiments that include a sticker or other adhesive material attached to a sock or other foot covering, the user may find the sole 307 for the correct foot (right foot indicated with an "R;" left foot indicated with an "L"), and turn the sticker mat over so that the sticker or other adhesive material, rather than the plastic, is exposed. As the user holds the sticker mat flat and secure (which may necessitate using one hand and knees), the user may carefully remove the sole 307 sticker from the "heel" up towards the "toes" area, being careful not to allow any of the exposed sticker area to fold in on itself or touch any object. The user may then apply the sole 307 sticker to the base of the foot and massage/press/rub into place. This will help keep the ankle strap 303, the outside ankle strap 304, the outside ball of the foot strap 305, and the inside big toe strap 306 in place and provide extra reinforcement for the sandal.

The process steps described above, either individually or in combination, may be repeated for both the paper practice pattern and the final application of the adhesive material to the foot covering (e.g., applying a pre-made sticker to a sock).

Once the product is complete, or at any other time during this process, the user may want to mark one or both of the foot covering and the adhesive material with permanent, or other marker so that the user can identify which is for the left foot and which is for the right for subsequent use. As noted above, the user may also wish to purchase and apply additional layers of the adhesive material to the bottom of the product as normal wear will wear down the layers of tape on the sole of the foot. This will allow for extended use of the original product.

Figure 6:
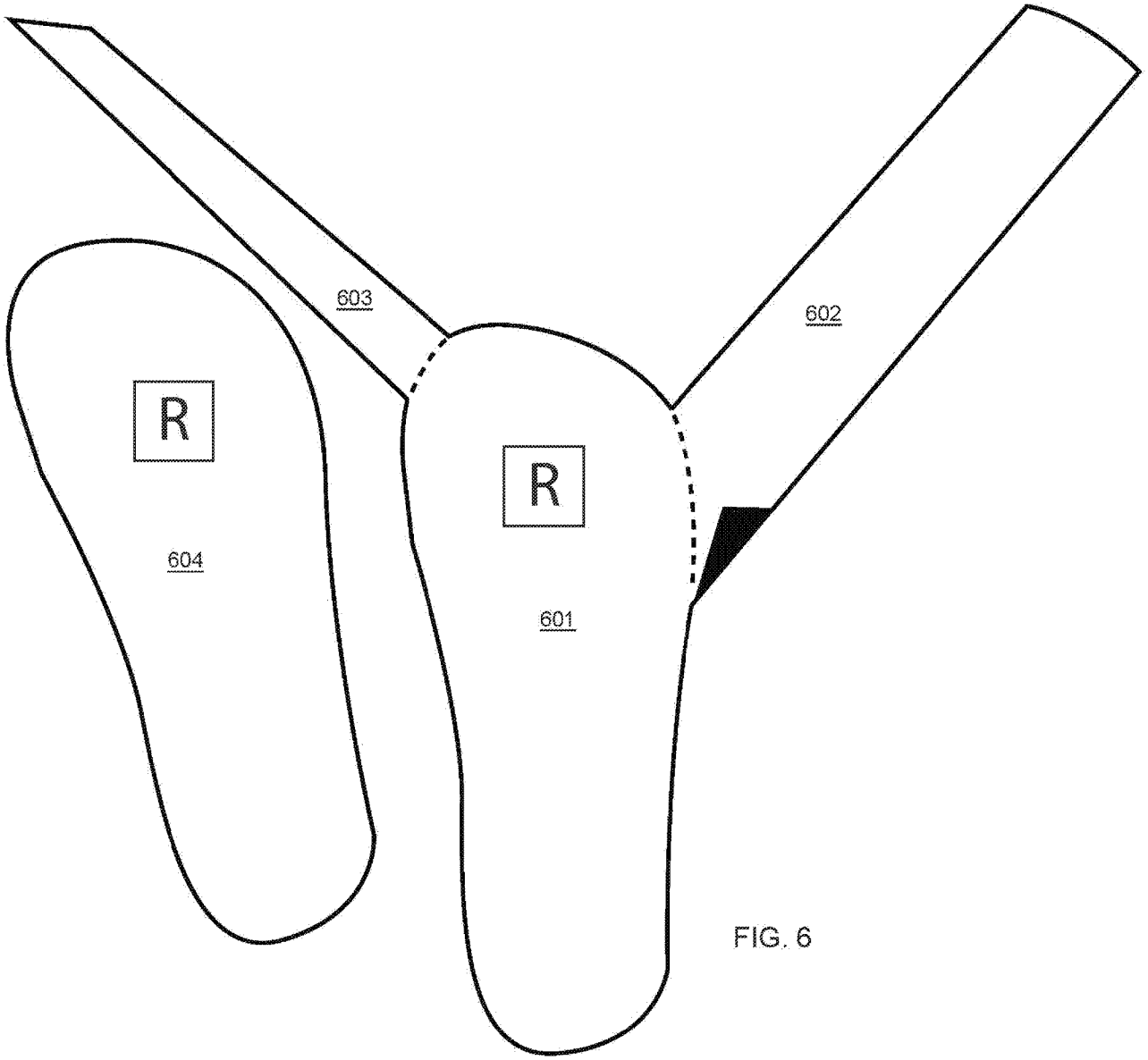
FIG. 6 illustrates an article of manufacture and method steps associated with the manufacture and use of a protective soft-shelled foot covering.
Figure 7:
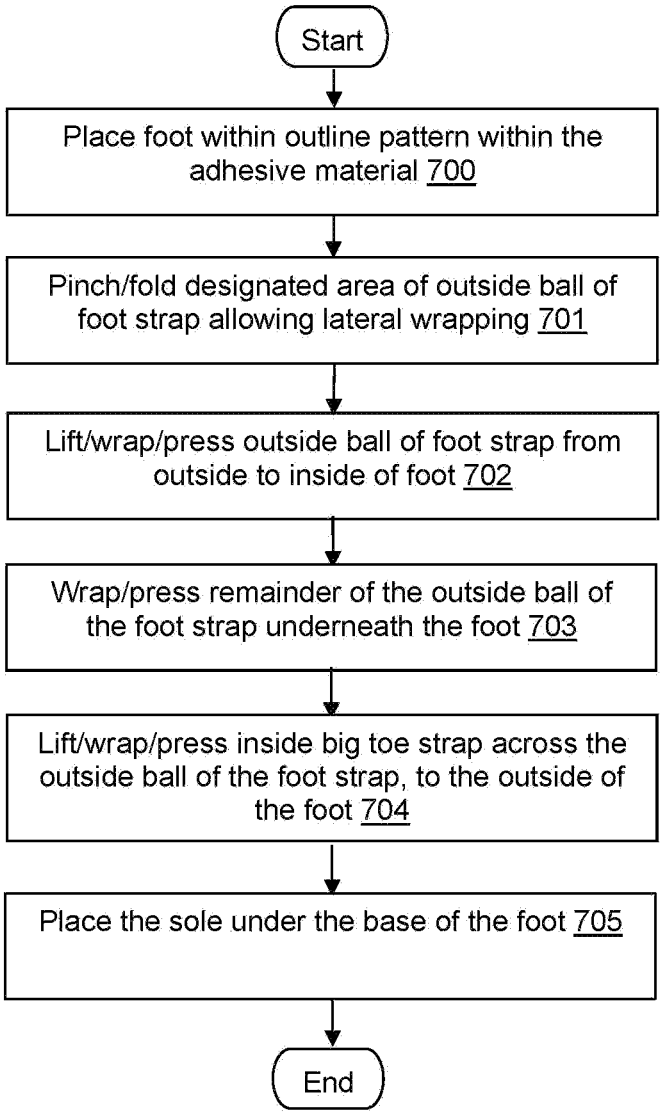
FIG. 7 illustrates an article of manufacture and method steps associated with the manufacture and use of a protective soft-shelled foot covering.

Turning now to FIGS. 6-7, which represent a more streamlined sandal style/version of the disclosed invention, the user may review the outline/pattern 601 for the foot to determine the appropriate foot (left or right) to place within the outline/pattern 601. As demonstrated in Step 700 of FIG. 7, the user may then place the appropriate foot within this area of the outline/pattern, with the heel of the foot flush against dotted line "heel" area of the cutout. By doing so, the user may also confirm that the sizing selected for the pattern is appropriate for their foot.

In embodiments that include a sticker or other adhesive material attached to a sock or other foot covering, the user may need to hold one of the top outside corners of the sticker-mat with one hand and kneel on the outside corners of the sticker-mat with their knees. The user may then peel the plastic from the heel of the outline/pattern 601 up towards the toes area, being careful not to allow any of the exposed sticker area to fold in on itself or touch any object. The user may then discard the removed plastic and carefully place the appropriate right or left foot in this area with the heel of the foot flush against the heel area of the outline/pattern 601.

The process steps described above, either individually or in combination, may be repeated for both the paper practice pattern and the final application of the adhesive material to the foot covering (e.g., applying a pre-made sticker to a sock).

Prior to applying the adhesive material in the subsequent steps, the user may want to lay a thin piece of tissue paper or other material around the toes area of the foot. This may prevent the adhesive material from constricting the toes or from being too tight in the toe area.

Turning now to Step 701 in FIG. 7, the user may pinch and fold a designated area of an outside ball of the foot strap 602 so that the outside ball of the foot strap 602 may wrap laterally across the foot. In step 702, the user may lift outside ball of the foot strap 602, and wrap and press it across the foot from the outside of the foot to the inside of the foot (i.e., from the right side of the foot to the left side on the right foot and from the left side of the foot to the right side on the left foot). In step 703, the user may wrap and press the remainder of the outside ball of the foot strap underneath the foot. In step 704, the user may loosely lift, wrap, and press an inside big toe strap 603 from the strap's origin, across the outside ball of the foot strap, to the outside little toe area, and/or the outside of the foot.

The process steps described above, either individually or in combination, may be repeated for both the paper practice pattern and the final application of the adhesive material to the foot covering (e.g., applying a pre-made sticker to a sock).

Turning now to Step 705 of FIG. 7, the user may find the sole 604 for the correct foot (right foot indicated with an "R;" left foot indicated with an "L") and place the sole 604 under the base of the foot. This will help keep the outside ball of the foot strap 602 and inside big toe strap 603 in place and provide extra reinforcement for the sandal, as disclosed above.

In embodiments that include a sticker or other adhesive material attached to a sock or other foot covering, the user may find the sole 604 for the correct foot (right foot indicated with an "R;" left foot indicated with an "L"), and turn the sticker mat over so that the sticker or other adhesive material, rather than the plastic, is exposed. As the user holds the sticker mat flat and secure (which may necessitate using one hand and knees), the user may carefully remove the sole 604 sticker from the "heel" up towards the "toes" area, being careful not to allow any of the exposed sticker area to fold in on itself or touch any object. The user may then apply the sole 604 sticker to the base of the foot and massage/press/rub into place. This will help keep the outside ball of the foot strap 602 and inside big toe strap 603 in place and provide extra reinforcement for the sandal, as disclosed above.

The process steps described above, either individually or in combination, may be repeated for both the paper practice pattern and the final application of the adhesive material to the foot covering (e.g., applying a pre-made sticker to a sock).

Once the product is complete, or at any other time during this process, the user may want to mark one or both of the foot covering and the adhesive material with permanent, or other marker so that the user can identify which is for the left foot and which is for the right for subsequent use. As noted above, the user may also wish to purchase and apply additional layers of the adhesive material to the bottom of the product as normal wear will wear down the layers of tape on the sole of the foot. This will allow for extended use of the original product.

Figure 8:
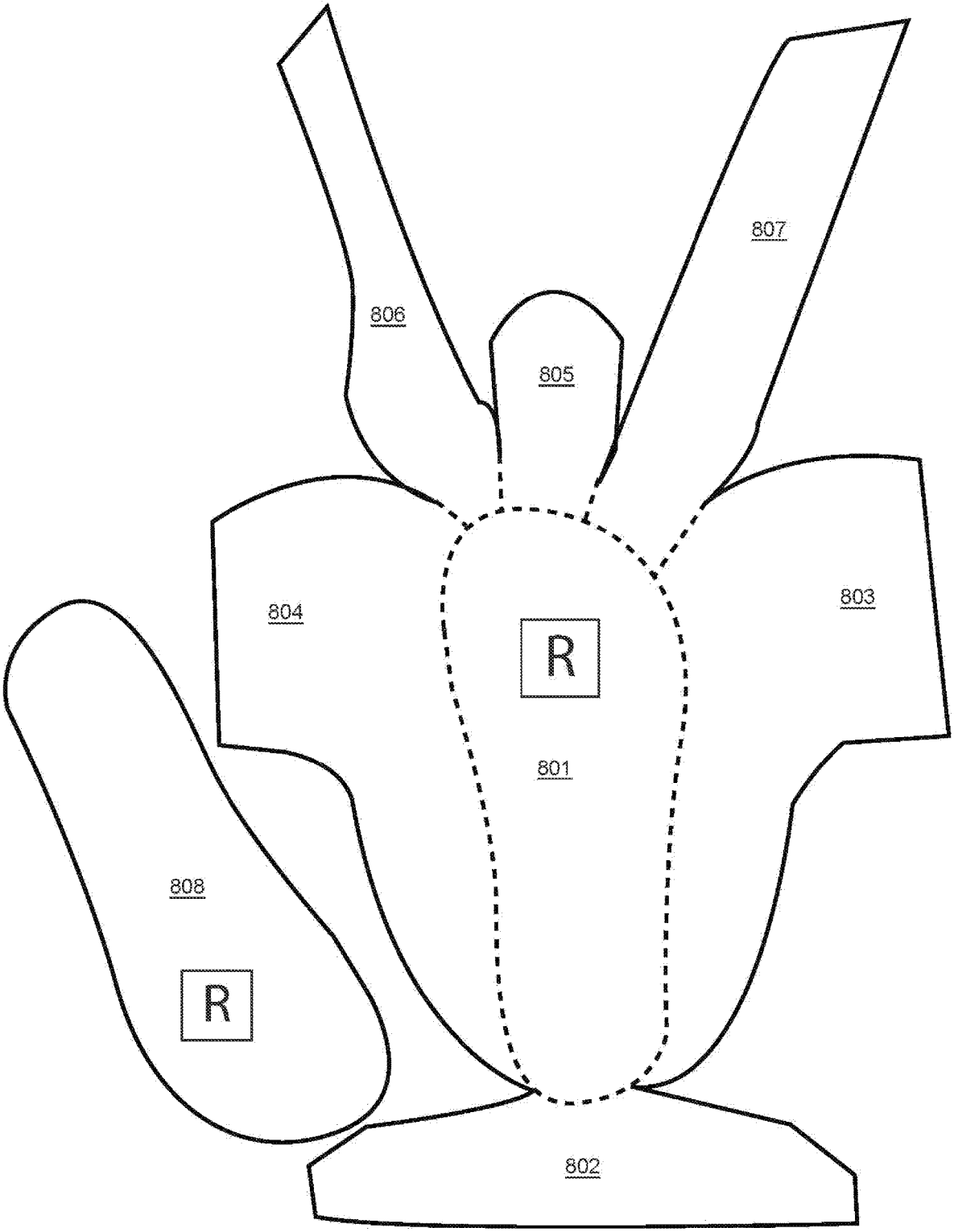
FIG. 8 illustrates an article of manufacture and method steps associated with the manufacture and use of a protective soft-shelled foot covering.
Figure 9:
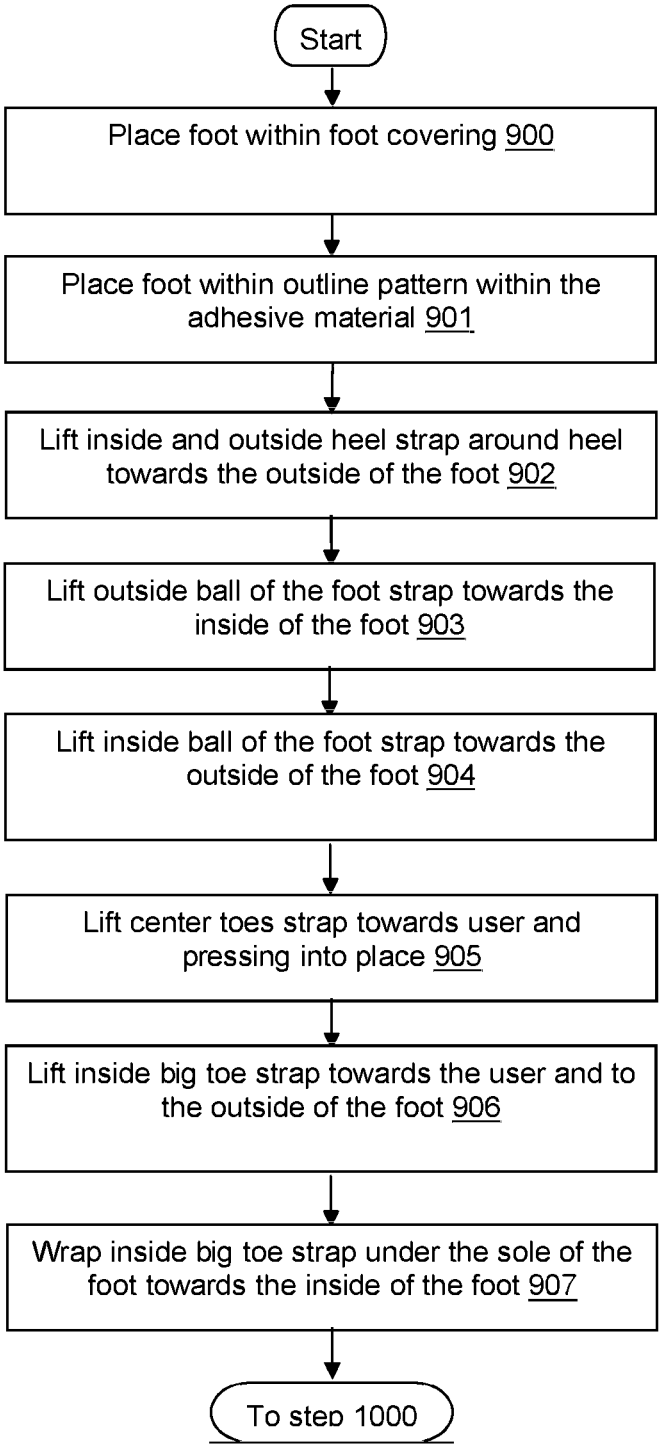
FIG. 9 illustrates an article of manufacture and method steps associated with the manufacture and use of a protective soft-shelled foot covering.
Figure 10:
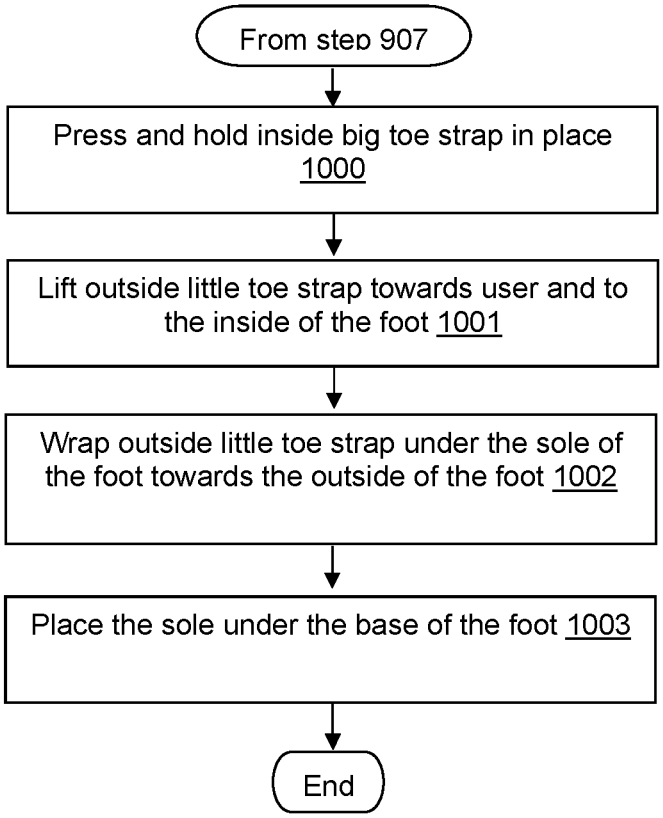
FIG. 10 illustrates an article of manufacture and method steps associated with the manufacture and use of a protective soft-shelled foot covering.

Turning now to FIGS. 8-10, which represent a shoe style/version of the disclosed invention, the user may review the outline/pattern 801 for the foot to determine the appropriate foot (left or right) to place within the outline/pattern 801. As demonstrated in Step 901 of FIG. 9, the user may then place the appropriate foot within this area of the outline/pattern, with the heel of the foot flush against dotted line "heel" area of the cutout. By doing so, the user may also confirm that the sizing selected for the pattern is appropriate for their foot.

In embodiments that include a sticker or other adhesive material attached to a sock or other foot covering, the user may need to hold one of the top outside corners of the sticker-mat with one hand and kneel on the outside corners of the sticker-mat with their knees. The user may then peel the plastic from the heel of the outline/pattern 801 up towards the toes area, being careful not to allow any of the exposed adhesive area to fold in on itself or touch any object. The user may then discard the removed plastic and carefully place the appropriate right or left foot in this area with the heel of the foot flush against the heel area of the outline/pattern 801.

The process steps described above, either individually or in combination, may be repeated for both the paper practice pattern and the final application of the adhesive material to the foot covering (e.g., applying a pre-made sticker to a sock).

Prior to applying the adhesive material in the subsequent steps, the user may want to lay a thin piece of tissue paper or other material around the toes area of the foot. This may prevent the adhesive material from constricting the toes or from being too tight in the toe area.

Turning now to Step 901 of FIG. 9, the user may lift up the inside and outside heel straps 802 of the cutout, and wrap and press the inside and outside heel straps 802, respectively around the back of the heel and towards the middle/lower outer sides of the foot so that the heel area looks and feels "fitted." The user may choose to place the inside and outside heel straps 802 so that they lie below the protruding portion of the respective lower ankle bones. Placing the inside and outside heel straps 802 too close, on, or above this area could result in uncomfortable rubbing and inflexibility. User may then need to hold the inside and outside heel straps 802 in place.

In embodiments that include a sticker or other adhesive material attached to a sock or other foot covering, the user may peel back the plastic for the inside and outside heel straps 802 from the inside area closest to the foot towards the outside edges of the sticker-mat, being careful not to allow any of the exposed sticker area to fold in on itself or touch any object. The user may choose to discard the removed plastic. The user may then carefully wrap and press the inside and outside heel straps 802 of the cutout around the back of the heel and towards the middle/lower outer sides of the foot so that the heel area looks and feels "fitted." The user may choose to place these the inside and outside heel straps 802 so that they lie below the protruding portion of the respective lower ankle bones. Placing the inside and outside heel straps 802 too close, on, or above this area could result in uncomfortable rubbing and inflexibility. The user may then press the inside and outside heel straps 802 into place.

The process steps described above, either individually or in combination, may be repeated for both the paper practice pattern and the final application of the adhesive material to the foot covering (e.g., applying a pre-made sticker to a sock).

Turning now to Step 903 in FIG. 9, the user may lift the outside ball of the foot strap 803 up and over the outside of the foot (right side for the right foot, and left side for the left foot) towards the inside of the foot (left side for the right foot, and right side for the left foot). The user may hold the outside ball of the foot strap 803 in place, which will, in turn hold the outside strap of the inside and outside heel straps 802 in place.

In embodiments that include a sticker or other adhesive material attached to a sock or other foot covering, the user may peel back the plastic from the outside ball of the foot strap 803, from the inside (area closest to the foot) towards the outside edges of the sticker-mat, being careful not to allow any of the exposed adhesive area to fold in on itself or touch any object. The user may choose to discard the removed plastic. The user may then carefully lift the outside ball of the foot strap 803 up and over the outside of the foot (right side for the right foot, and left side for the left foot) towards the inside of the foot (left side for the right foot, and right side for the left foot). The user may press the outside ball of the foot strap 803 into place, which will, in turn hold the outside strap of the inside and outside heel straps 802 in place.

The process steps described above, either individually or in combination, may be repeated for both the paper practice pattern and the final application of the adhesive material to the foot covering (e.g., applying a pre-made sticker to a sock).

Turning now to Step 904 of FIG. 9, the user may lift the inside ball of the foot strap 804 up and over the inside of the foot (left side for the right foot, and right side for the left foot) towards the outside of the foot (right side for the right foot, and left side for the left foot) and hold the inside ball of the foot strap 804 in place. The user may hold the inside ball of the foot strap 804 in place, which will cover most of the outside ball of the foot strap 803, and which will, in turn, hold the inside and outside heel straps 802, as well as the outside ball of the foot strap 803 in place.

In embodiments that include a sticker or other adhesive material attached to a sock or other foot covering, the user may peel back the plastic from inside ball of the foot strap 804 from the inside (area closest to the foot) towards the outside edges of the sticker-mat, being careful not to allow any of the exposed adhesive area to fold in on itself or touch any object. The user may choose to discard the removed plastic. The user may then carefully lift the inside ball of the foot strap 804 up, wrapping and pressing over the inside of the foot towards the outside and press down. This will cover most of the outside ball of the foot strap 803, and which will, in turn, hold the inside and outside heel straps 802, as well as the outside ball of the foot strap 803 in place.

The process steps described above, either individually or in combination, may be repeated for both the paper practice pattern and the final application of the adhesive material to the foot covering (e.g., applying a pre-made sticker to a sock).

Turning now to Step 905 in FIG. 9, the user may lift the center toes strap 805 towards themselves and press it down into place, thereby covering at least part of the outside ball of the foot strap 803 and the inside ball of the foot strap 804. The user should take care to not apply the center toes strap 805 too tightly to the toe area, in order to give the toes freedom to move, creating an unrestricted sensation for the user, as if they're running barefoot, for example.

In embodiments that include a sticker or other adhesive material attached to a sock or other foot covering, the user may peel back the plastic for the center toes strap 805 from the inside (area closest to the foot) towards the outside edges of the sticker-mat, being careful not to allow any of the exposed adhesive area to fold in on itself or touch any object. The user may choose to discard the removed plastic. The user should take care to not to apply the center toes strap 805 too tightly to the toe area, in order to give the toes freedom to move, creating an unrestricted sensation for the user, as if they're running barefoot, for example. The user may then carefully lift and fold the center toes strap 805 towards themselves and press it down into place, thereby covering at least part of the outside ball of the foot strap 803 and the inside ball of the foot strap 804.

The process steps described above, either individually or in combination, may be repeated for both the paper practice pattern and the final application of the adhesive material to the foot covering (e.g., applying a pre-made sticker to a sock).

Turning now to Steps 906-907 of FIG. 9 and Step 1000 of FIG. 10, the user may lift the inside big toe strap 806 towards themselves and slightly to the outside of the foot (right side for the right foot, and left side for the left). The user may continue pressing the inside big toe strap 806 towards the outside of the foot, then continue wrapping under the sole of the foot which will then work its way under the foot towards the inside of the foot. The user may then press and hold the big toe strap 806 in place, again taking care not to apply the big toe strap 806 too tightly to the toe area in order to give the user's toes freedom to move. The big toe strap 806 may partially cover the center toes strap 805.

In embodiments that include a sticker or other adhesive material attached to a sock or other foot covering, the user may peel back the plastic for the inside big toe strap 806 from the inside (area closest to the foot) towards the outside edges of the sticker-mat, being careful not to allow any of the exposed adhesive area to fold in on itself or touch any object. The user may choose to discard the removed plastic. The user should take care not to apply the inside big toe strap 806 too tightly to the toe area in order to give the toes freedom to move, creating an unrestricted sensation for the user, as if they're running barefoot, for example. The user may then carefully lift and fold the big toe strap 806 towards themselves, wrapping and pressing slightly to the outside of the foot. The user may then continue wrapping/pressing the inside big toe strap 806 around towards the outside of the foot, then continue pressing/wrapping around and then under the sole of the foot towards the inside of the foot. Finally, the user may press down and smooth out the inside big toe strap 806, making its sticker flush with the underlying stickers. The inside big toe strap 806 may partially cover center toes strap 805.

The process steps described above, either individually or in combination, may be repeated for both the paper practice pattern and the final application of the adhesive material to the foot covering (e.g., applying a pre-made sticker to a sock).

Turning now to Steps 1001-1002 in FIG. 10, the user may lift the outside little toe strap 807 towards themselves and slightly to the inside of the foot (left side for the right foot, and right side for the left). The user may continue pressing the outside little toe strap 807 around towards the inside of the foot, then continue. The user may then press and hold the outside little toe strap 807 in place, again, taking care not to apply the outside little 807 too tightly to the toe area in order to give the user's toes freedom to move. The outside little toe strap 807 will partially cover the center toe strap 805 and the inside big toe strap 806.

In embodiments that include a sticker or other adhesive material attached to a sock or other foot covering, the user may peel back the plastic for the outside little toe strap 807 from the inside (area closest to the foot) towards the outside edges of the sticker-mat, being careful not to allow any of the exposed adhesive area to fold in on itself or touch any object. The user may choose to discard the removed plastic The user should take care not to apply the outside little toe strap 807 too tightly to the toe area in order to give the toes freedom to move, creating an unrestricted sensation for the user, as if they're running barefoot, for example. The user may then carefully lift and fold the outside little toe strap 807 towards themselves, then wrap and press it slightly to the inside of the foot. The user may then continue wrapping/pressing the outside little toe strap 807 around towards the inside of the foot, and continue wrapping/pressing the remainder of the outside little toe strap 807 under the sole of the foot. Finally, the user may press down and smooth out the outside little toe strap 807, making the adhesive material flush with the adhesive material and the underlying straps. The outside little toe strap 807 will at least partially cover the center toes strap 805 and the inside big toe strap 806.

The process steps described above, either individually or in combination, may be repeated for both the paper practice pattern and the final application of the adhesive material to the foot covering (e.g., applying a pre-made sticker to a sock).

Turning now to Step 1003 in FIG. 10, the user may find the sole 808 for the correct foot (right foot indicated with an "R;" left foot indicated with an "L") and place the sole 808 under the base of the foot. This will help keep the inside big toe strap 806, and the outside little toe strap 807 in place, and provide extra reinforcement for the shoe.

In embodiments that include a sticker or other adhesive material attached to a sock or other foot covering, the user may find the sole 808 for the correct foot (right foot indicated with an "R;" left foot indicated with an "L"), and turn the sticker mat over so that the sticker or other adhesive material, rather than the plastic, is exposed. As the user holds the sticker mat flat and secure, which may necessitate using one hand and knees, the user may carefully remove the sole 808 sticker from the "heel" up towards the "toes" area, being careful not to allow any of the exposed sticker area to fold in on itself or touch any object. The user may then apply the sole 808 sticker to the base of the foot and massage/press/rub into place. This will help keep the inside big toe strap 806, and outside little toe strap 807 in place and provide extra reinforcement for the shoe.

The process steps described above, either individually or in combination, may be repeated for both the paper practice pattern and the final application of the adhesive material to the foot covering (e.g., applying a pre-made sticker to a sock).

Once the product is complete, or at any other time during this process, the user may want to mark one or both of the foot covering and the adhesive material with permanent, or other marker so that the user can identify which is for the left foot and which is for the right for subsequent use. As noted above, the user may also wish to purchase and apply additional layers of the adhesive material to the bottom of the product as normal wear will wear down the layers of tape on the sole of the foot. This will allow for extended use of the original product.

The steps included in the embodiments illustrated and described in relation to FIGS. 1-10 are not limited to the embodiment shown in FIGS. 1-10 and may be combined in several different orders and modified within multiple other embodiments. Although disclosed in specific combinations within these figures, the steps disclosed may be independent, arranged and combined in any order and/or dependent on any other steps or combinations of steps.

Other embodiments and uses of the above inventions will be apparent to those having ordinary skill in the art upon consideration of the specification and practice of the invention disclosed herein. The specification and examples given should be considered exemplary only, and it is contemplated that the appended claims will cover any other such embodiments or modifications as fall within the true scope of the invention.

The Abstract accompanying this specification is provided to enable the United States Patent and Trademark Office and the public generally to determine quickly from a cursory inspection the nature and gist of the technical disclosure and in no way intended for defining, determining, or limiting the present invention or any of its embodiments.

The invention claimed is:

1. A method comprising the steps of: placing a foot of a user within a foot covering; placing the foot with the foot covering within an outline pattern, along a surface of the outline pattern comprising an adhesive material;

lifting an inside heel strap and an outside heel strap of the outline pattern around the back of the heel and towards the sides of the foot;

lifting an outside ball strap of the outline pattern on the outside of a ball of the foot, up and over the outside of the foot towards the inside of the foot, thereby holding the outside ball strap, the inside heel strap, and the outside heel strap in place;

lifting an inside ball strap of the outline pattern on the inside of the ball of the foot, up and over the inside of the foot towards the outside of the foot, thereby holding the inside ball strap, the inside and outside heel straps, and the outside ball strap in place;

lifting a center toes strap of the outline pattern towards the user and pressing the center toes strap, thereby covering at least part of the outside ball strap and the inside ball strap;

lifting an inside big toe strap of the outline pattern towards the user and to the outside of the foot; wrapping the inside big toe strap under the sole of the outside of the foot towards the inside of the foot; pressing and holding the inside big toe strap, thereby at least partially covering the center toes strap;

lifting an outside little toe strap of the outline pattern towards the user and to the inside of the foot; wrapping the outside little toe strap under the base of the inside of the foot, towards the outside of the foot;

pressing and holding the outside little toe strap, thereby at least partially covering the center toes strap and the inside big toe strap; and placing a sole under the outline pattern, which is under the base of the foot, thereby keeping the outside little toe strap, and the inside big toe strap in place.

2. The method of claim 1, wherein the foot covering is a sock.

3. The method of claim 2, wherein the sock is a wool sock.

4. The method of claim 1, wherein the adhesive material is any combination of: duct tape, surgical/medical tape, gaffer tape, speed tape, stick tape, cloth, leather, wood, moleskin, deerskin, synthetic leather, rope, hemp, cloth, paper, rubber, foam, microfiber, plastic, plastic wrap, tin foil and metal.

5. The method of claim 1, wherein the foot covering includes a plurality of markings as a guide to affix the adhesive material to the foot covering.

6. The method of claim 1, wherein the adhesive material is printed from a pattern downloaded from a website operated by a manufacturer.

7. A method comprising the steps of:

downloading, from a manufacturer website, a digital outline pattern;

printing the digital outline pattern onto a material to form an outline pattern;

placing a foot of a user within a foot covering;

placing the foot with the foot covering within the outline pattern, along a surface of the outline pattern comprising an adhesive material;

lifting an inside heel strap and an outside heel strap of the outline pattern around the back of the heel and towards the sides of the foot;

lifting an outside ball strap of the outline pattern on the outside of a ball of the foot, up and over the outside of the foot towards the inside of the foot, thereby holding the outside ball strap, the inside heel strap, and the outside heel strap in place;

lifting an inside ball strap of the outline pattern on the inside of the ball of the foot, up and over the inside of the foot towards the outside of the foot, thereby holding the inside ball strap, the inside and outside heel straps, and the outside ball strap in place;

lifting a center toes strap of the outline pattern towards the user and pressing the center toes strap, thereby covering at least part of the outside ball strap and the inside ball strap;

lifting an inside big toe strap of the outline pattern towards the user and to the outside of the foot; wrapping the inside big toe strap under the sole of the outside of the foot towards the inside of the foot; pressing and holding the inside big toe strap, thereby at least partially covering the center toes strap;

lifting an outside little toe strap of the outline pattern towards the user and to the inside of the foot;

wrapping the outside little toe strap under the base of the inside of the foot, towards the outside of the foot;

pressing and holding the outside little toe strap, thereby at least partially covering the center toes strap and the inside big toe strap; and placing a sole under the outline pattern, which is under the base of the foot, thereby keeping the outside little toe strap, and the inside big toe strap in place.

8. The method of claim 7, wherein the foot covering is a sock.

9. The method of claim 8, wherein the sock is a wool sock.

10. The method of claim 7, wherein the adhesive material is any combination of: duct tape, surgical/medical tape, gaffer tape, speed tape, stick tape, cloth, leather, wood, moleskin, deerskin, synthetic leather, rope, hemp, cloth, paper, rubber, foam, microfiber, plastic, plastic wrap, tin foil and metal.

11. The method of claim 7, wherein the foot covering includes a plurality of markings as a guide to affix the adhesive material to the foot covering.

* * * * *